US005941762A

United States Patent [19]

Ravkin et al.

[11] Patent Number: 5,941,762

[45] Date of Patent: Aug. 24, 1999

[54] METHOD AND APPARATUS FOR IMPROVED CONDITIONING OF POLISHING PADS

[76] Inventors: Michael A. Ravkin, 1215 W. Knickerbocker Dr., Sunnyvale; Ilya A. Ravkin, 945 Colorado Ave., Palo Alto; Yuli Verhovsky, 3937 Brookline Way, Redwood City, all of Calif. 94062

[21] Appl. No.: 09/003,904

[22] Filed: Jan. 7, 1998

[51] Int. Cl.[6] ..... B24B 1/00

[52] U.S. Cl. ..... 451/56; 451/72; 451/443

[58] Field of Search ..... 451/56, 72, 443, 451/444, 287, 288

[56] References Cited

U.S. PATENT DOCUMENTS 5,154,021 10/1992 Bombardier et al. .
5,486,131 1/1996 Cesna et al. .
5,547,417 8/1996 Breivogel et al. .
5,611,943 3/1997 Cadien et al. .
5,779,521 7/1998 Muroyama et al. ..... 451/56
5,782,675 7/1998 Southwick ..... 451/56
5,857,899 1/1999 Volodarsky ..... 451/72

*Primary Examiner*—David A. Scherbel
*Assistant Examiner*—Shantese McDonald
*Attorney, Agent, or Firm*—Blakely, Sokoloff, Taylor & Zafman

[57] ABSTRACT

A method and apparatus for conditioning the surface of a polishing pad used to polish a substrate, such as a semiconductor wafer. A conditioning apparatus uses two or more end effectors to abrade and/or remove the polishing byproducts from the surface of the pad. Different types of conditioning performance can be achieved when the end effectors are employed individually, sequentially or simultaneously during a polishing process.

20 Claims, 6 Drawing Sheets

METHOD AND APPARATUS FOR IMPROVED CONDITIONING OF POLISHING PADS

BACKGROUND OF THE INVENTION

1. Field of the Invention

This invention relates generally to the field of semiconductor processing technology. More specifically, this invention relates to the conditioning and cleaning of polishing pads used in the substrate polishing and planarization process of semiconductor manufacturing.

2. Description of the Related Art

During the manufacturing process of an integrated circuit, a semiconductor wafer is often polished to remove unwanted materials on the surface of the wafer. The polishing or planarization process can also remove a layer or a partial layer comprised of a material (usually of thin film), such as dielectric, metal or polysilicon, deposited on the surface of a semiconductor wafer in order to form the necessary interconnects, insulation and various components of the integrated circuit.

One such process involves polishing the substrate on a polishing pad. One polishing process is commonly referred to as Chemical-Mechanical Polishing (CMP). In a typical arrangement, a substrate is supported by a carrier which presses the substrate against the surface of a moving polishing pad. The polishing process may take place in the presence of a polishing slurry, water (with or without some amount of suitable chemical), or without any such agent, but generally with CMP a polishing slurry is utilized. The polishing process continues in this manner until the desired surface of the substrate is planarized or in some cases completely removed.

During the polishing process, the properties of the polishing pad can change. Slurry particles and polishing byproducts accumulate on the surface of the pad. Polishing byproducts and morphology changes on the pad surface affect the properties of the polishing pad and cause the polishing pad to suffer from a reduction in both its polishing rate and performance uniformity. However, pad conditioning restores the polishing pad's properties by re-abrading or otherwise restoring the surface of the polishing pad. This conditioning process enables the pad to maintain a stable removal rate while polishing a substrate or planarizing a deposited layer and lessens the impact of pad degradation on the quality of the polished substrate.

During the conditioning process, a conditioner (also referred to as an end effector) used to recondition the polishing pad's surface comes into contact with the pad and re-abrades the pad's surface. The type of conditioner used depends on the pad type. For example, hard polishing pads, typically constructed of synthetic polymers such as polyurethane, require the conditioner to be made of a very hard material, such as diamond, serrated steel, or ceramic bits, to recondition the pad. Intermediate polishing pads with extended fibers require a softer material, often a brush with stiff bristles, to recondition the pad. Meanwhile, soft polishing pads, such as those made of felt, are best conditioned by a soft bristle brush or a pressurized spray.

Pad conditioning devices known in the prior art employ a single conditioning means or end effector which is brought into contact with the polishing pad. Generally, the selected conditioner is designed to recondition a specific type of pad surface. For example, U.S. Pat. No. 5,154,021 raises flattened pad fibers with a downward directed stream of air. This method works best on the intermediate pad surfaces with longer pad fibers, but is not as successful on harder pad surfaces such as polyurethane. On the other hand, U.S. Pat. Nos. 5,486,131 and 5,547,417 recondition the pad surface using cutting means and a grooved block fitted with diamond tips, respectively. These methods are well suited for harder polishing pads like polyurethane, but would be too rough for a more intermediate pad surface. Thus, every time the type of polishing pad on the polishing machine changes, the conditioning mechanism must also be replaced with a conditioner having properties necessary to condition the new type of pad. This requires the polishing machine user to maintain several different types of conditioning devices, one for each different type of polishing pad used. Also, time is required to change the conditioner.

Similarly, the prior art does not allow for complex conditioning of a polishing pad. Complex conditioning involves a more controlled and varied conditioning than is currently possible. For example, the polishing pad of an orbital polishing machine often becomes more worn along the track the wafer follows during polishing. Conditioning of the wafer track may require reabrasion of the pad surface with a diamond cutting means followed by brushing off the pad surface with a soft bristle. In contrast, the area outside the wafer track often merely needs to be brushed with a soft bristle or rinsed. This type of varied conditioning treatment is not possible when only one conditioning means is available for use with each polishing apparatus.

In addition to only being able to condition a single type of pad, the prior art conditioners are utilized to re-abrade the polishing pad. A conditioner having an independent means for cleaning the re-abraded pad would be desirable. It would also be advantageous to simultaneously or sequentially re-abrade and clean the pad without stopping the polishing process to change the conditioning medium.

SUMMARY OF THE INVENTION

The present invention is a method and apparatus for conditioning the surface of a polishing pad by using a plurality of conditioning materials to recondition the surface of the polishing pad. The present invention is used to polish substrates and other materials and is applicable for use on both linear and orbital polishing machines and their respective polishing pads. The present invention comprises a conditioning device which includes at least two conditioners, wherein the conditioners have different conditioning materials and conditioning properties.

One embodiment of the present invention comprises two conditioners coupled to a conditioning arm. The first conditioner utilizes a hard material (such as diamond, serrated steel, or ceramic bits) and the second conditioner utilizes a soft material (such as synthetic fibers of nylon or polypropylene). Each conditioner is adapted for movement to bring it into contact with the surface of the polishing pad. The conditioners may engage the pad simultaneously or independently of one another. During the polishing process, the conditioners can be made to react in a variety of ways to engage the pad. For example, the force applied by each conditioner to the polishing pad can be varied both with time and with respect to the amount of force applied by other conditioners. Also, during the conditioning process, each conditioner can be made adjustable to move in a linear movement along the conditioning arm and/or rotate about a vertical axis normal to the polishing pad.

Thus, by employing multiple conditioning means to condition the polishing pad, additional and/or complex performance characteristics can be obtained for conditioning the pad. The plurality of conditioning means also saves the amount of the downtime of the equipment for replacing or changing the conditioning element.

DETAILED DESCRIPTION OF THE INVENTION

This disclosure describes a method and apparatus for conditioning a surface of a polishing pad used to polish substrates and/or materials deposited on a substrate, such as a semiconductor wafer or a substrate used in the manufacturing of flat panel displays. The following description sets out numerous specific details, such as specific structures, materials, polishing techniques, etc. to provide a thorough understanding of the present invention. However, one skilled in the art will appreciate that the present invention can be practiced without these specific details. In other instances, this description does not describe well know techniques and structures in detail in order not to obscure the present invention. Although this disclosure describes the present invention in reference to conditioning pads used to polish semiconductor wafers, the present invention is readily adaptable to condition pads used to polish other materials such as glass or substrates for the manufacture of flat panel displays.

A polishing machine is used in semiconductor manufacturing to planarize various layers (such as thin films) formed on a substrate (such as a silicon wafer). During polishing, the face of the wafer is disposed to engage the polishing pad. Typically, the wafer is supported by a carrier which applies a downward force to press the wafer face downward onto the pad. A polishing slurry is typically present to perform Chemical-Mechanical Polishing (CMP). As the polishing pad moves relatively across the surface of the wafer, the mechanical abrasive motion in presence of the slurry polishes away a selected material on the surface of the wafer. The material removed can be the substrate material of the wafer itself or one of the layers formed on the wafer. The formed layer may include dielectric materials, metals, metal alloys or semiconductor materials.

Figure 1A:
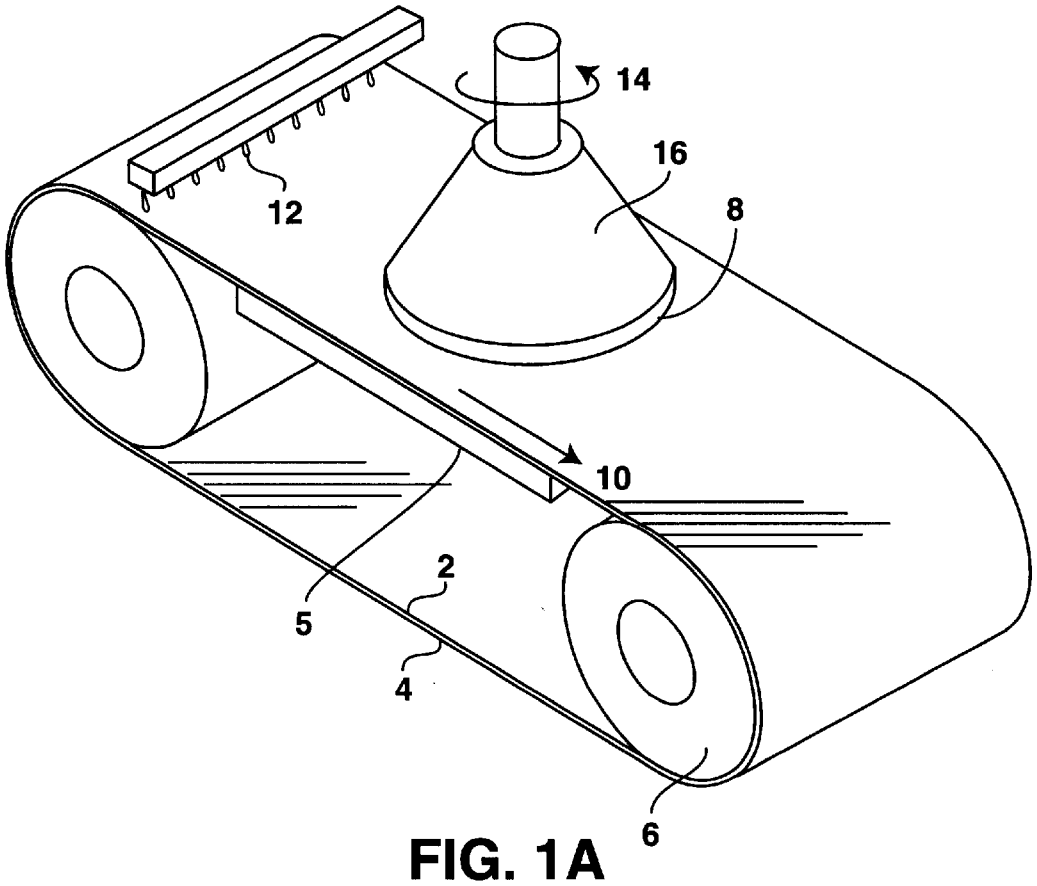
FIG. 1A illustrates a linear polishing tool known in the prior art.

FIG. 1A shows a linear polishing tool used for performing CMP. The linear polishing tool uses a continuous belt 2 with a polishing pad 4 attached to the outer surface of the belt 2. The belt 2 and the attached polishing pad 4 rotate about rollers 6 to move linearly with respect to the surface of the wafer 8 as shown by arrow 10. A platen 5 provides support for the pad and belt combination as the carrier 16 presses the wafer 8 onto the pad 4 during the polishing process. A polishing slurry 12 is dispersed from a slurry dispenser. Additionally, the carrier 16 can rotate (as shown by arrow 14) to further facilitate the polishing process.

Figure 1B:
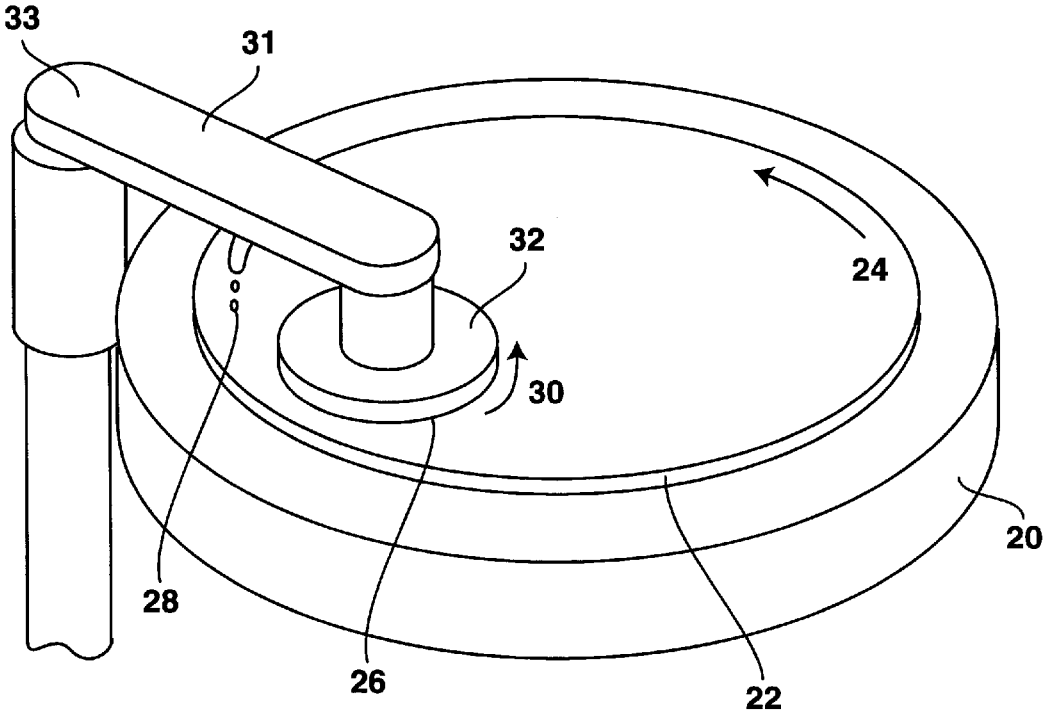
FIG. 1B illustrates an orbital polishing tool known in the prior art.

FIG. 1B shows an orbital polishing tool also used for performing CMP. The orbital polishing tool uses a circular platen 20 with a polishing pad 22 disposed on the platen's upper surface. The platen 20 and the polishing. pad 22 rotate about a circular axis (as shown by arrow 24) to move angularly with respect to the surface of the wafer 26. As with the linear polishing machine, a slurry 28 is dispensed onto the pad 22. The carrier 32 can rotate (as shown by arrow 30) independently of the pad's rotation 24. The arm 31 may also rotate about axis 33 to move the carrier 32 and attached wafer 26 across the surface of the polishing pad 22.

During the operation of either type of polishing assembly, the properties of the polishing pad change. The polishing pad often becomes worn and unevenly compressed. Additionally, slurry particles and polishing byproducts accumulate on the surface of the pad and become imbedded in the pad surface. The polishing byproducts affect the roughness of the polishing pad and cause the polishing pad to suffer from a reduction in both its polishing rate and performance uniformity. However, pad conditioning restores the polishing pad's properties by re-abrading and/or cleaning the surface of the polishing pad. This conditioning process (also referred to as reconditioning) enables the pad to continue polishing a wafer and lessens the impact of pad degradation on the quality of the polished wafer.

As previously described in the Background section, a number of disadvantages are noted with the use of prior art conditioners employing a single conditioning element or means. The present invention conditions (or reconditions) the polishing pad using more than one conditioning material. A conditioner having two parts, each part being comprised of a separate conditioning material, is brought into contact with the polishing pad. In the preferred embodiment, two or more conditioners (also referred to as end effectors) are used to recondition the surface of the polishing pad. The movement of the polishing pad against the surface of the conditioner re-abrades the surface of the polishing pad and/or removes any polishing byproducts or waste from the surface of the polishing pad. Since the conditioning materials are different, the pad conditioning characteristics will also differ, depending on which conditioning material (or medium) is engaging the pad.

Figure 2A:
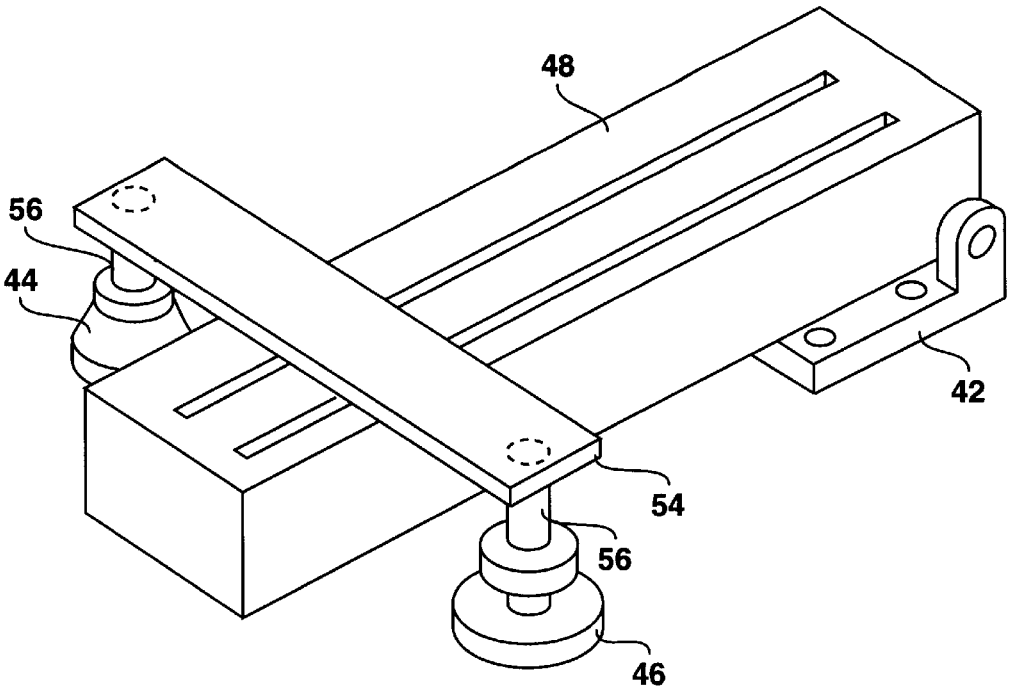
FIG. 2A illustrates an embodiment of a conditioning device of the present invention in which the device is generally utilized with a linear polishing tool, such as the one shown in FIG. 1A.
Figure 2B:
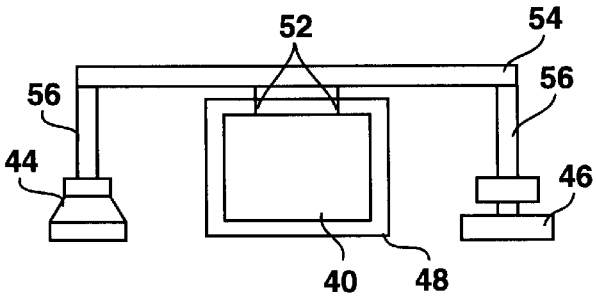
FIG. 2B illustrates a side view of the conditioning device of FIG. 2A.

FIGS. 2A and 2B illustrate a first embodiment of a conditioning device of the present invention for use with a linear polishing tool, such as the one shown in FIG. 1A. The conditioning apparatus comprises at least two end effectors 44 and 46 coupled to a support arm (also referred to as a conditioning arm) 40, with the conditioning arm 40 cantilevered to a base 42. The conditioning arm 40 is surrounded by a mechanism cover 48 to minimize exposure of the conditioning arm 40 to the polishing byproducts. The mechanism cover 48 has tracks 50 through which support members 52 attach to the conditioning arm 40 at one end and mechanically couple to a support bracket 54 at an opposite end. End effectors 44 and 46 couple to the support bracket 54 by arms 56.

Figure 2C:
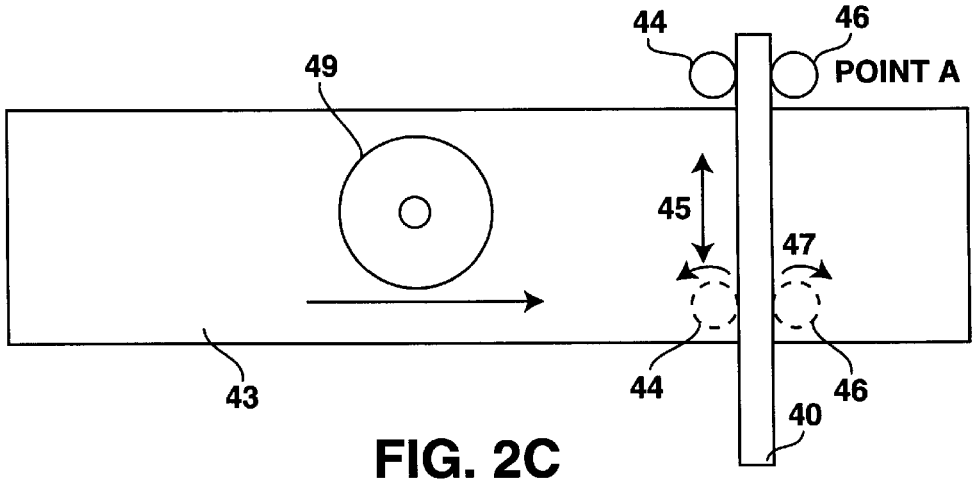
FIG. 2C illustrates a top view of the conditioning device of FIG. 2A as used with a linear polishing tool.

Although more than two end effectors can be used, the first embodiment uses two end effectors 44 and 46. End effector 44 has a hard element, such as diamond bits, serrated steel bits, ceramic bits, or stiff synthetic fibers attached to its bottom surface. A typical hard end effector has nickel plated diamond particles with grit in the range of about 80 to 120 mesh, U.S. Sieve Series. A softer element, such as synthetic fibers of nylon or polypropylene, is attached to the bottom surface of end effector 46. The size of the different types of particles attached to each end effector may be varied, depending on the degree of pad conditioning required. The larger the size of the particle, the deeper and more aggressive is the re-abrasion action (given the same engagement force). The exact shape or material of the end effectors themselves is not critical to the practice of the invention. However, in the first embodiment, the end effectors are round and generally vary from one to six inches in diameter. The actual size of the end effectors is a design choice dictated mostly by the size of the tool and the size of the wafer being polished FIG. 2C shows a top view of the first embodiment of the conditioning device of the present invention as used with a linear polishing tool. The pad conditioning apparatus, comprising the conditioning arm 40 and end effectors 44 and 46, is positioned in a spaced relationship across the linear polishing pad 43. Typically, it is desirable to locate the conditioning arm 40 so as to engage the end effectors 44 and 46 onto the pad 43 after the pad has passed by the wafer 49. That is, as the pad travels linearly, the pad engages the wafer first and then engages the conditioners.

The conditioning arm 40 is generally stationary when used with a linear polishing tool, but can be designed to allow repositioning of the conditioning arm 40 to a desired height and/or linear position relative to the polishing pad. The end effectors 44 and 46 begin at a home position (point A) and move linearly (in direction 45) along the conditioning arm 40 and across the surface of the polishing pad 43. Although the movement may be achieved manually, it is preferable that the movement of the end effectors be mechanically driven. For example, end effectors 44 and 46 may be coupled to a motor, a linear pneumatic actuator, a lead screw device, or other such means to allow linear movement along the conditioning arm 40 by the end effectors. However, if the end effector was wider than the wafer 49, linear movement of the end effector along the conditioning arm 40 would not be necessary to maintain a uniform reconditioning of the polishing pad along the wafer track. Similarly, rotation 47 of the end effectors about a vertical axis normal to the surface of the polishing pad 43 may be used to further facilitate the reconditioning of the polishing pad 43. The rotating shaft of the end effector may be driven by a motor, rotary pneumatic actuator, or other such means.

Figure 3A:
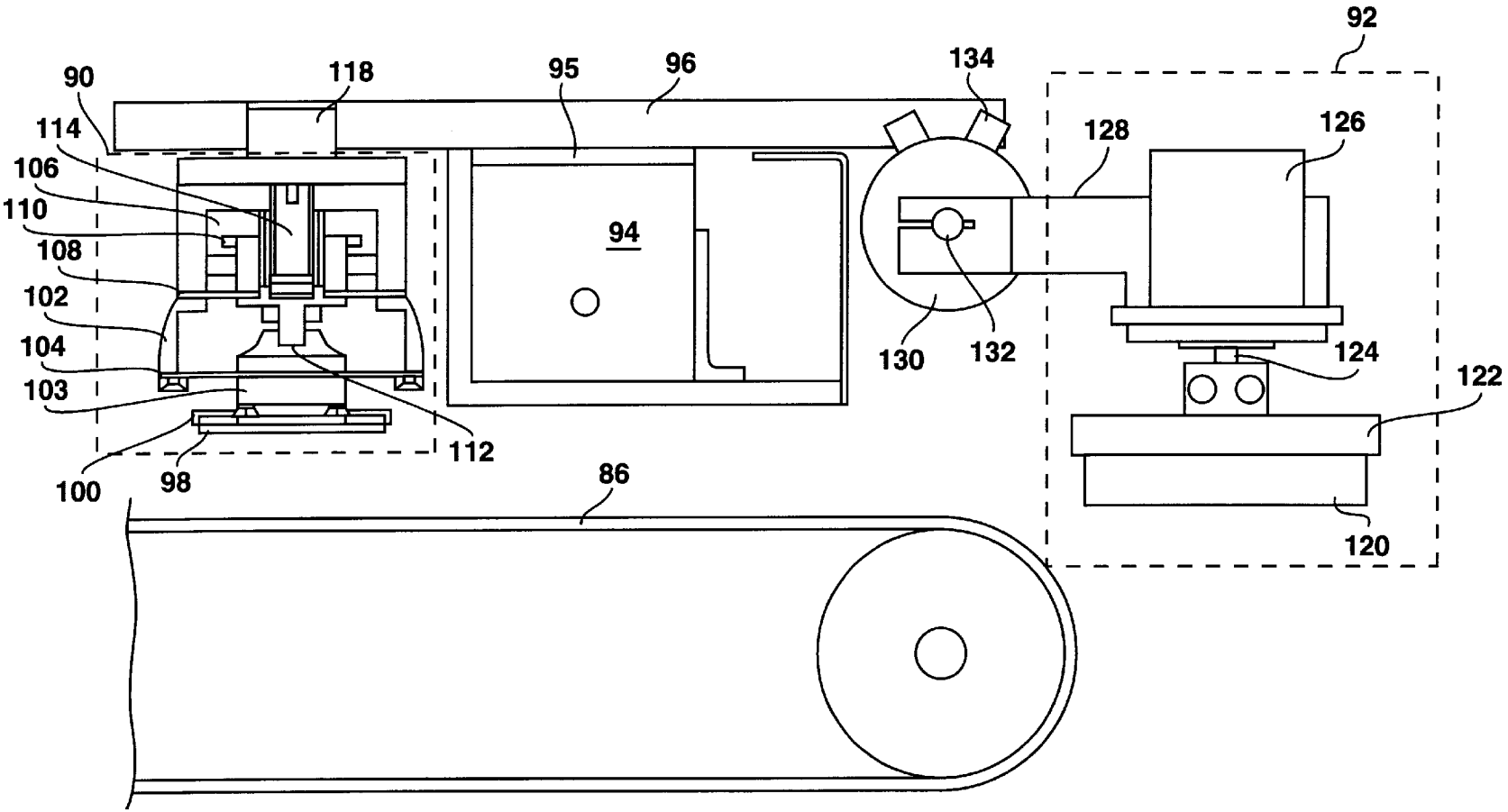
FIG. 3A illustrates a side view of a second embodiment of a conditioning device of the present invention in which the device is generally utilized with a linear polishing tool.
Figure 3B:
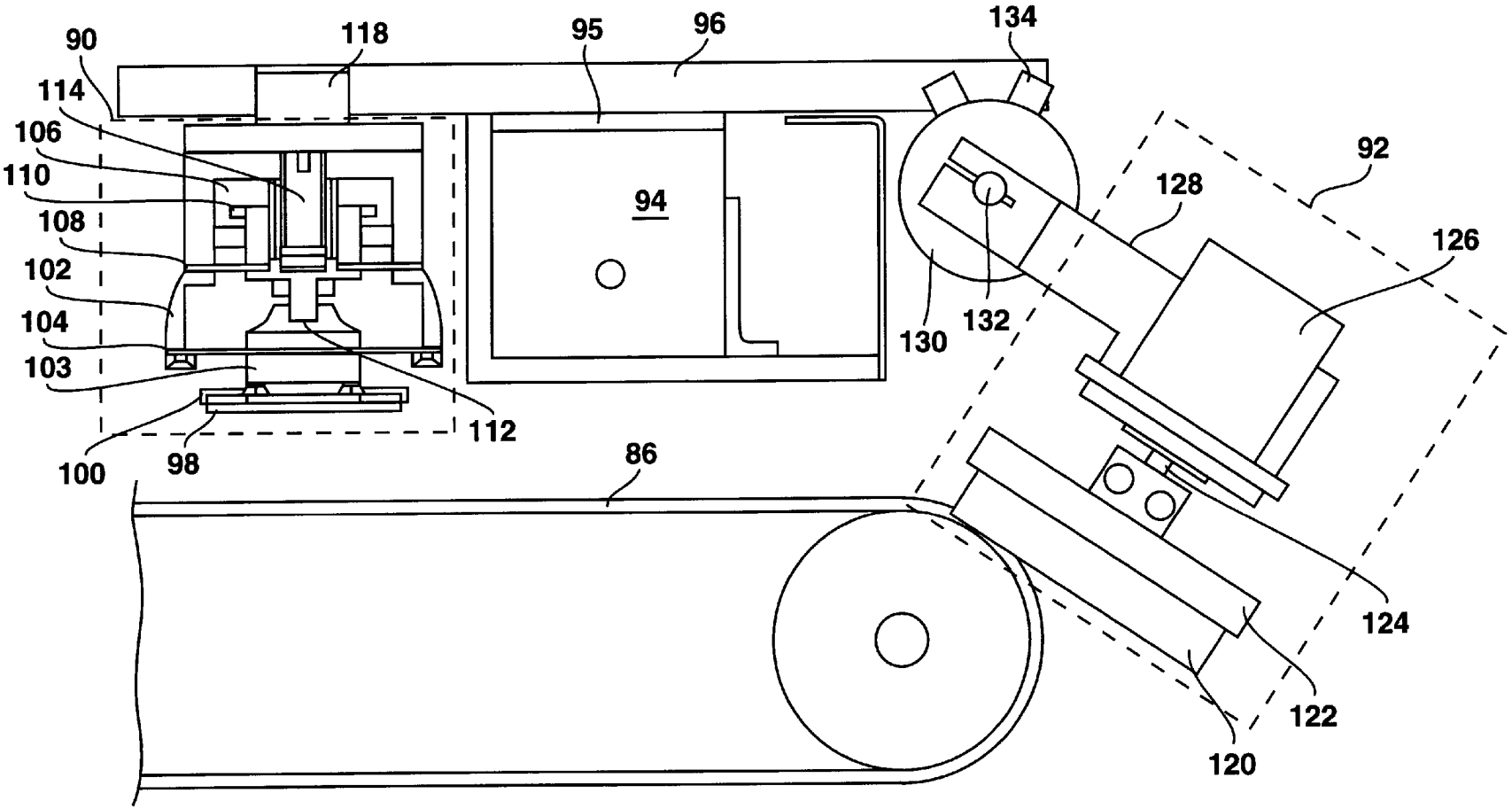
FIG. 3B illustrates the position of the conditioning device of FIG. 3A during the conditioning process.

FIGS. 3A and 3B illustrate a second embodiment of a conditioning device of the present invention for use with a linear polishing tool, such as the one shown in FIG. 1A. As with the first embodiment, two end effectors 90 and 92 (one with a hard element and the other with a softer element) couple to a conditioning arm 94.

End effector 90 is used for abrasive conditioning. The face 98 of end effector 90 comprises hard particles, such as diamond particles, and fits inside a magnetic holder 100. The holder 100 couples to a diaphragm 104 by a connecting piece 103. The diaphragm 104 attaches to the outer housing 102 of the end effector 90 and isolates the inside of end effector 90 from slurry and polishing byproducts. Space 106 is sealed by a diaphragm 108. Compressed air is released into space 106 by a regulator and valve to create a downward force and bring the face 98 of end effector 90 into contact with the polishing pad 86. The downward movement is limited by fins 110. A ball-and-socket 112 allows a gimballing motion to occur in response to the lateral forces created by the linear motion of the polishing pad across the face 98 of end effector 90. A central shaft 114 limits the amount of gimballing that can occur. By allowing the face 98 of end effector 90 to gimbal in response to the lateral forces, the abrasive conditioning of the polishing pad 86 will occur more uniformly.

The second end effector 92 is used to remove the slurry and polishing byproducts loosened by the abrasive property of the first end effector 90. A brush component of the end effector 92 is comprised of synthetic fibers 120 held by base 122. Base 122 couples to motor shaft 124 of the motor within housing 126. This motor controls the rotation of the brush when the brush is in contact with the polishing pad 86. An arm 128 couples the motor housing 126 to a rotating shaft 132 of a rotary pneumatic actuator within housing 130. The actuator causes the end effector 92 to pivot about rotating shaft 132 until the fibers 120 of the brush come into contact with the polishing pad 86. FIG. 3A shows the position of end effector 92 when not in use, and FIG. 3B shows the position of end effector 92 during the conditioning process.

Both end effectors 90 and 92 are coupled to a support bracket 96 which is coupled to a conditioning arm 94. End effector 92 is coupled to the support bracket 96 by brace 134. A small shaft 118 couples end effector 90 to support bracket 96. The shaft 118 has screws to adjust the height of end effector 90 with respect to the polishing pad 86. The support bracket 96 attaches to slide 95. Slide 95 is then coupled to the conditioning arm 94 which contains a linear sliding mechanism, such as a lead screw or one of the earlier mentioned devices, by which slide 95 is moved. In this manner, end effectors 90 and 92 are moved linearly along the conditioning arm 94 (in the same manner as direction 45 in FIG. 2C) and thus across the surface of the polishing pad 86.

Figure 4A:
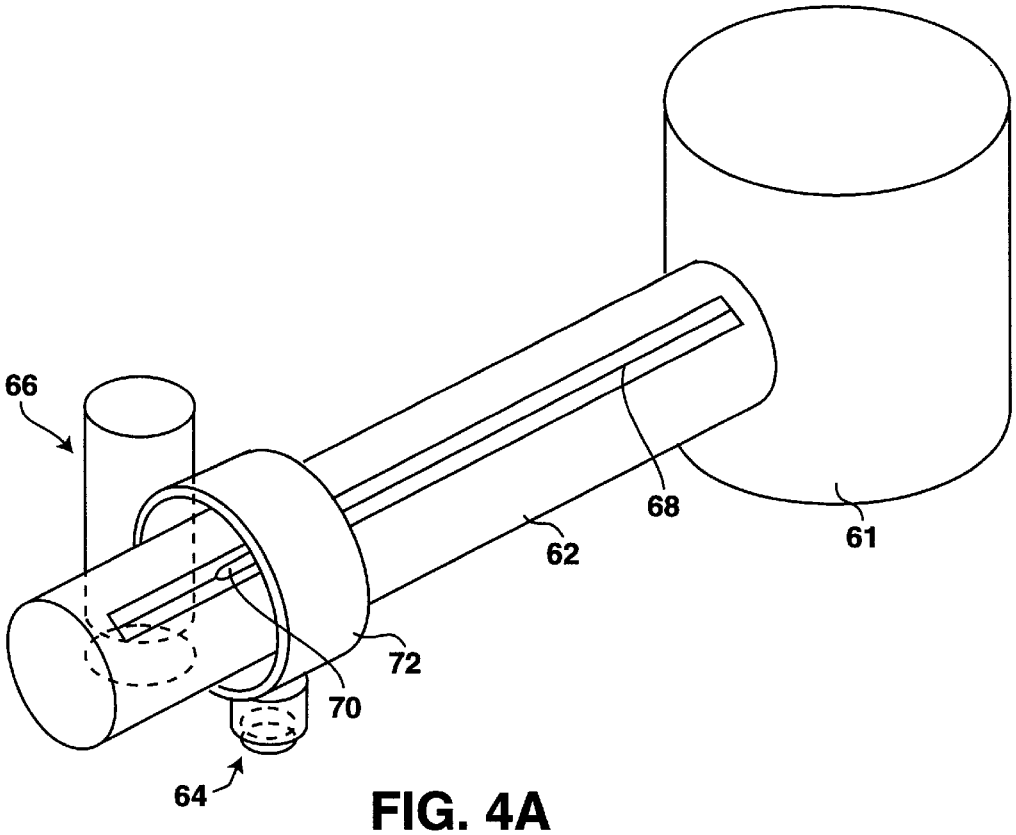
FIG. 4A illustrates an embodiment of a conditioning device of the present invention in which the device is generally utilized with an orbital polishing tool, such as the one shown in FIG. 1B.

In an equivalent manner to that described above for use with a linear polishing tool, the conditioning device of the present invention may also be used to condition the polishing pad of an orbital polishing tool. FIGS. 4A and 4B illustrate a third embodiment of a conditioning apparatus of the present invention for use with an orbital polishing tool, such as the one shown in FIG. 1 B. As with the device used with the linear polishing machine, this conditioning device also comprises two end effectors 64 and 66 that are coupled to a conditioning arm 60. The conditioning arm 60, coupled to a base 61 around which it may pivot, is surrounded by a mechanism cover 62 that minimizes exposure of the conditioning arm 60 to the polishing byproducts. The mechanism cover 62 has tracks 68 through which support members 70 attach to the conditioning arm 60 at one end and couple to a support ring 72 at the opposite end. Mounting blocks 74 are attached to the support ring 72. Each end effector 64 and 66 couples to a mounting block 74.

End effector 64 is used for abrasive conditioning and is similar to end effector 90 (see FIG. 3A) described in the second embodiment. The face 65 of end effector 64 comprises diamond particles and is held in place by a magnetic holder 67. The holder 67 is coupled with a diaphragm 69 that isolates the inside of end effector 64 from slurry and polishing byproducts. A second diaphragm 71 seals space 73. Compressed air is released into space 73 by an automatic regulator and valve to create a downward force and bring the face 65 into contact with the polishing pad. A ball-and-socket 75 allows a gimballing motion to occur in response to the lateral forces created by the linear motion of the polishing pad across the face 65 of end effector 64. A central shaft 77 limits the amount of gimballing that can occur. By allowing the face 65 of end effector 64 to gimbal in response to the lateral forces, the abrasive conditioning of the polishing pad will occur more uniformly.

End effector 66 is used to remove the slurry and polishing byproducts loosened by abrasive end effector 90. A brush comprising synthetic fibers 78 is held by base 79. A connecting piece 80 attaches the base 79 of the brush to the frame 81. An air cylinder 82 provides a downward force by extending shaft 83 against frame 81 to lower the brush into contact with the polishing pad. The couplings with ball bearings 84 allow the brush to gimbal slightly to adjust for any lateral forces created by the polishing pad against the fibers 78 during the conditioning process. However, the space 86 between the frame 81 and the base 79 limits any gimballing motion. A motor shaft 87 of the motor 86 couples to the central shaft 88 of the end effector and controls rotation of the brush once the brush is lowered and in contact with the polishing pad.

Figure 4C:
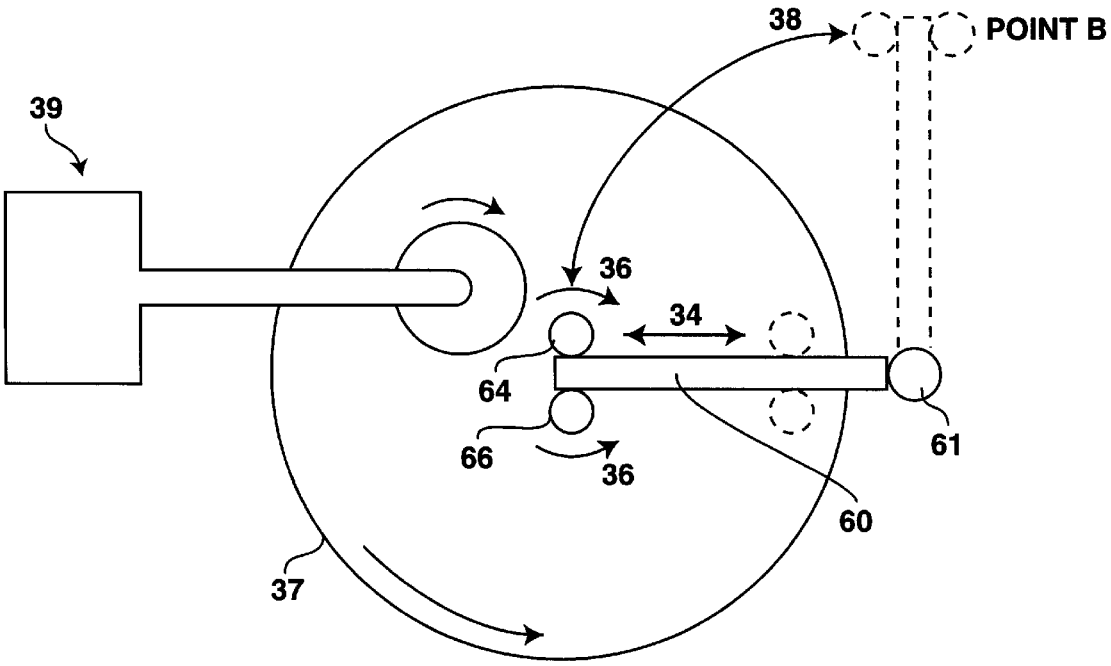
FIG. 4C illustrates a top view of the conditioning device of FIG. 4A as used with an orbital polishing tool.
Figure 4B:
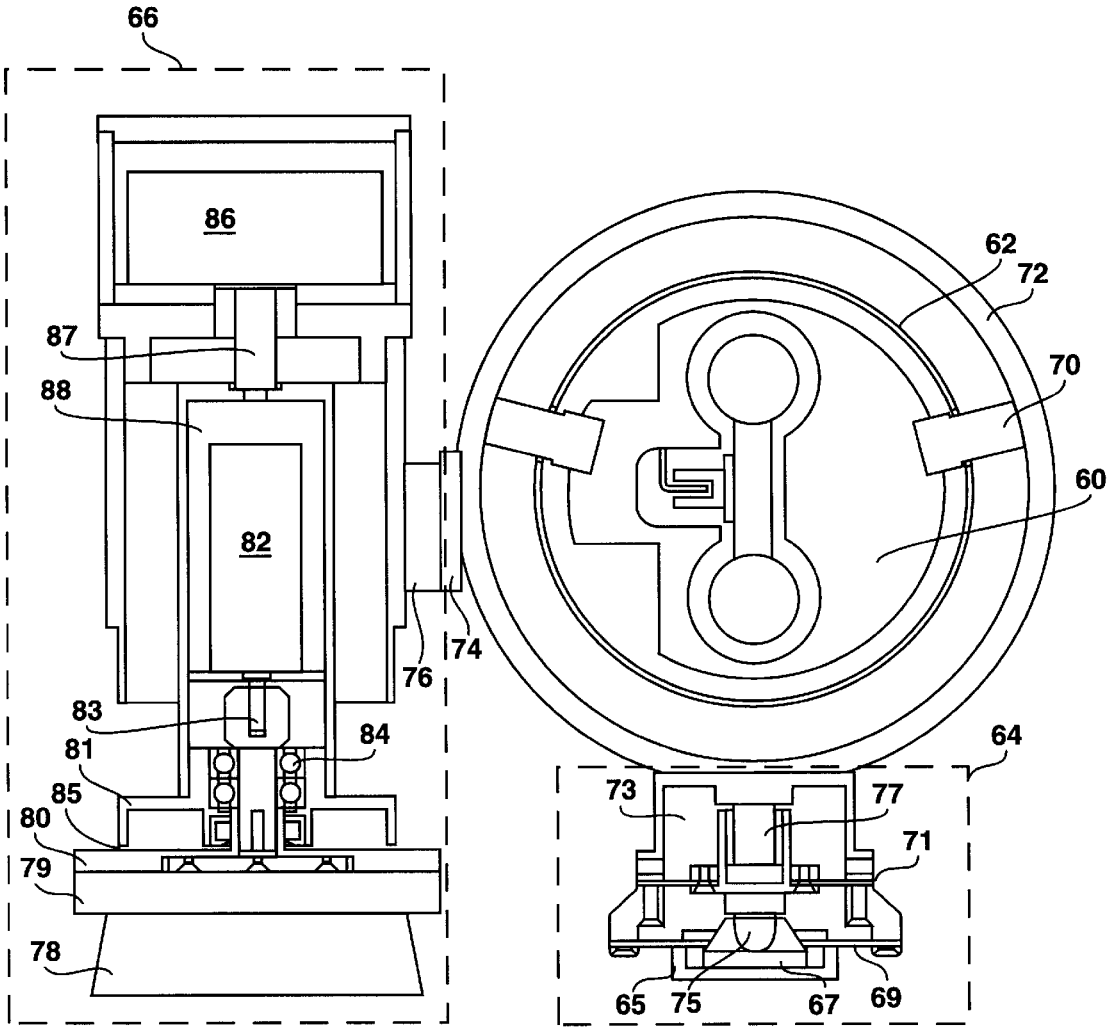
FIG. 4B illustrates a side view of the conditioning device of FIG. 4A.

FIG. 4C shows a top view of the third embodiment of a conditioning device of the present invention as used with an orbital polishing tool 29, such as the one shown in FIG. 1B. The conditioning apparatus, comprising the conditioning arm 60 and end effectors 64 and 66, begins in a home position at point B to the side of the polishing tool and pivots about path 38 until it is in a spaced relation parallel to the polishing pad 37. The end effectors 64 and 66 move linearly 34 along the conditioning arm 60 and may also independently rotate 36 about a vertical axis normal to the surface of the polishing pad. In addition to the movement of the end effectors, the conditioning arm 60 may sweep along path 38 during the conditioning process to further condition the polishing pad 37 from the center of the pad to its outside edge, depending on the relative size of the polishing pad, the wafer being polished, and the end effectors. The angular movement of the conditioning arm 60 can be achieved using a motor, rotary pneumatic actuator or other such means that would typically be housed within the base 61.

As discussed in the above embodiments, different types of end effectors may be used to achieve different types of conditioning characteristics. Other means than those detailed above are also available. For example, an end effector directing a stream of air, water, or some other agent at the polishing pad could be used to remove imbedded slurry and polishing byproducts. The force of the fluid and the amount of fluid directed at the polishing pad could be varied to achieve a variety of conditioning characteristics.

The present invention's use of multiple end effectors with different properties provides many advantages over the prior art. With the practice of the present invention, whether on a linear or an orbital polisher, each end effector can be independently controlled with respect to when it is lowered or otherwise brought into contact with the polishing pad, the amount of force it applies to the polishing pad once in contact with the pad, and the movement (both linear and angular) it makes while in contact with the polishing pad.

One advantage of the present invention is its ability to recondition pads of different types without requiring the end effectors to be replaced each time a different type of pad is used. Accordingly, providing a plurality of conditioning elements, by way of end effectors, allows the polishing process to not be interrupted when different conditioning characteristics are needed. It also reduces the downtime of the tool when more than one conditioning element is required.

The present invention also addresses the need for complex conditioning of a pad and the conditioning of different pad types by placing two or more end effectors with different properties on the same pad conditioning mechanism. The present invention allows one or more end effectors of the appropriate material, depending on the properties of the polishing pad, to come into contact with the surface of the polishing pad and recondition the surface of the pad. Thus, when using a hard polishing pad, the hard end effector lowers to recondition the polishing pad. Likewise, when using a softer polishing pad, the softer end effector lowers to recondition the polishing pad.

By allowing multiple end effectors to independently work under different process conditions, the present invention provides another method of allowing the same conditioning apparatus to be used to condition pads of different properties. For example, the force being applied by one end effector onto the polishing pad may be significantly higher than the force applied by another end effector to the pad's surface. In this manner, a different degree of abrasion could by created depending on the characteristics of the polishing pad and the amount of force applied. Thus, multiple polishing pads with different properties may be reconditioned without switching out the end effectors. Furthermore, with proper monitoring and control, in-situ adjustments could be made to vary the conditioning characteristics or profile before, during, or after performing CMP.

In addition, the presence of two or more end effectors with different properties on the same pad conditioning mechanism allows the polishing byproducts to be loosened by a hard end effector and then brushed or washed away by a second softer end effector. This is an improvement over the current technique of abrading the surface and assuming the slurry added during the polishing process would flush the reconditioned area and wash away any loosened material.

Thus, a conditioning mechanism employing a plurality of end effectors and in which at least two different conditioning medium or materials are utilized with the end effectors to condition the polishing pad is described.

We claim:

1. An apparatus for conditioning a surface of a polishing pad utilized for polishing a surface, comprising:

a first conditioner having a first conditioning material;

a second conditioner coupled to said first conditioner and having a second conditioning material which is different from said first conditioning material.

2. The apparatus of claim 1 wherein said first conditioning material is comprised of a hardened abrasive material.

3. The apparatus of claim 2 wherein said second conditioning material is comprised of a softer abrasive material than said first conditioning material.

4. The apparatus of claim 2 wherein said first conditioning material is comprised of diamond bits, steel bits or ceramic bits.

5. The apparatus of claim 4 wherein said second conditioning material is comprised of synthetic fibers.

6. An apparatus for conditioning a surface of a polishing pad utilized for polishing a surface, comprising:

a support arm;

a first conditioner coupled to said support arm and having a first conditioning material resident thereon for providing a first conditioning characteristic when conditioning said polishing pad; and a second conditioner coupled to said support arm and having a second conditioning material resident thereon for providing a second conditioning characteristic when conditioning said polishing pad.

7. The apparatus of claim 6 wherein said first and second conditioners are adjustable in a linear motion along said support arm.

8. The apparatus of claim 6 wherein at least one of said first and second conditioners rotates about a vertical axis normal to said polishing pad to condition said polishing pad.

9. The apparatus of claim 6 wherein said first and second conditioners engage said polishing pad by an exertion of different amounts of force against said polishing pad.

10. The apparatus of claim 6 wherein said conditioners are utilized for conditioning the surface of the polishing pad of a linearly moving pad.

11. The apparatus of claim 6 wherein said conditioners are utilized for conditioning the surface of the polishing pad of a rotating platen.

12. The apparatus of claim 6 wherein said first conditioning material is comprised of a hardened abrasive material.

13. The apparatus of claim 12 wherein said second conditioning material is comprised of a softer abrasive material than said first conditioning material.

14. The apparatus of claim 12 wherein said first conditioning material is comprised of diamond bits, steel bits or ceramic bits.

15. The apparatus of claim 14 wherein said second conditioning material is comprised of synthetic fibers.

16. In a polishing tool, a method of conditioning a surface of a polishing pad utilized for polishing a surface, comprising the steps of:

conditioning the surface of the polishing pad with a first conditioner; and, conditioning the surface of the polishing pad with a second conditioner without removing said first conditioner from said polishing tool.

17. The method of claim 16 wherein said conditioning steps include said first and second conditioners to condition the surface of the polishing pad simultaneously.

18. The method of claim 16 wherein said conditioning steps include said first and second conditioners to condition the surface of the polishing pad sequentially.

19. The method of claim 16 wherein said conditioning steps include said first and second conditioners to each exert different downward force when engaging the polishing pad.

20. The method of claim 16 wherein said conditioning steps include said first conditioner to engage the polishing pad with a hardened abrasive material and said second conditioner to engage the polishing pad with a softer abrasive material than said first conditioner.

* * * * *

UNITED STATES PATENT AND TRADEMARK OFFICE

CERTIFICATE OF CORRECTION

PATENT NO : 5,941,762

DATED : August 24, 1999

INVENTOR(S) : Michael A. Ravkin, Ilya A. Ravkin, Yuli Verhovsky

It is certified that error appears in the above-identified patent and that said Letters Patent are hereby corrected as shown below:

Column 3, line 47, please replace "know" with --known--.

Column 4, line 18, please delete the "." that appears after the term polishing.

Column 8, line 27, please replace "by" with --be--.

Signed and Sealed this

Ninth Day of May, 2000

*Attest:*

*Attesting Officer*

Q. TODD DICKINSON

*Director of Patents and Trademarks*